US005494468A

United States Patent [19]

Demarco, Jr.

[11] Patent Number: 5,494,468

[45] Date of Patent: Feb. 27, 1996

[54] FLIPPER ENERGY SOURCE

[75] Inventor: James S. Demarco, Jr., Waterford, Conn.

[73] Assignee: The United States of America as represented by the Secretary of the Navy, Washington, D.C.

[21] Appl. No.: 382,306

[22] Filed: Jan. 25, 1995

[51] Int. Cl.[6] ..... A63B 31/08

[52] U.S. Cl. ..... 441/64

[58] Field of Search ..... 310/319, 339, 310/328, 330–332, 800; 441/61–64; 114/315; 440/6

[56] References Cited

U.S. PATENT DOCUMENTS 4,814,661 3/1989 Ratzlaff et al. ..... 310/328

5,065,067 11/1991 Todd et al. ..... 310/319

5,259,798 11/1993 Runckel ..... 441/64

5,336,959 8/1994 Park et al. ..... 310/328

*Primary Examiner*—Edwin L. Swinehart

*Attorney, Agent, or Firm*—Michael J. McGowan; Prithvi C. Lall; Michael F. Oglo

[57] ABSTRACT

A flipper energy source for generating electricity includes a flipper or fin having an opening for engaging a foot and a body portion extending therefrom. The body portion includes fluid displacing surfaces which are adapted to be moved through the fluid for creating a propelling force via the movement. Such movement causes stress to be created on the surfaces of the body portion. The device further includes a piezoelectric element for converting the stress into electric power. The electric power thus generated is conditioned for use in powering electrical device(s), such as, for example, lighting, communications devices, battery rechargers, photography equipment and sonar transducers.

17 Claims, 1 Drawing Sheet

FLIPPER ENERGY SOURCE

STATEMENT OF GOVERNMENT INTEREST

The invention describes herein may be manufactured and used by or for the Government of the United States of America for Governmental purposes without the payment of any royalties thereon or therefore.

BACKGROUND OF THE INVENTION (1) Field of the Invention

This invention is directed toward underwater power generation, and more particularly, to a flipper or fin which incorporates a piezoelectric element into its structure for generating electric power which can be used to electrically power auxiliary devices. This invention provides a means for generating electrical energy while scuba diving for a variety of applications, particularly, for powering electrical devices underwater.

(2) Description of the Prior Art

Scuba divers generally utilize flippers or fins as one means of underwater propulsion or thrust. In use the flippers are flexed back and forth in the water to enable a diver to move or maintain a particular depth. Flippers are generally formed from a flexible neutrally buoyant material and the size and shape of the flipper depends upon the diving conditions.

Frequently, it is necessary for a diver to use underwater equipment when diving. Much of this equipment requires electrical power and such equipment can be heavy. Because divers rely upon their physical resources while diving underwater, the weight of the equipment places an additional load on the diver. This equipment also generally requires underwater battery packs (electrochemical or storage cells) which can be equally as bulky and heavy as the equipment, adding further to the diver's load. A diver's physical stamina decreases as the load increases. Accordingly, any decrease in the load is beneficial to the diver.

An example of an electrical device for use in underwater diving would be lighting for use in night dives. Vision is poor in night dives, making it necessary to carry lighting so as to give the diver a direction and also to illuminate the diver for safety purposes. A solo diver with no buddy line is not clearly visible during night dives without lighting. Thus, it is necessary for the diver to carry lighting and a source to power the lighting. It would be beneficial in such situations if the diver was able to generate power for the lighting in the water as opposed to carrying a power source with him. Such a system is not shown in the prior art, however, some patents do exist which illustrate devices that generate power via the motion of objects.

U.S. Pat. No. 4,387,318 to Kolm et al. discloses a piezoelectric fluid-electric generator. The generator includes a piezoelectric bending element and means for mounting one end of the bending element in a fluid stream. A blade is provided which is mounted to the end of the bending element and which is adapted to be placed into the fluid stream. Electrode means, connected to the piezoelectric bending element, conduct current from the generator to a device. Upon placement of the blade in a fluid stream, the blade is caused to oscillate, which causes the bending element to oscillate, which generates electricity.

U.S. Pat. No. 4,404,490 to Taylor et al. discloses a device which generates power from waves near the surface of bodies of water. The device includes a piezoelectric structure comprising piezoelectric material members preferably in the form of sheets. Each sheet has an electrode on opposite surfaces thereof. Each pair of electrodes with the piezoelectric material therebetween defines a power generating element, each of which is preferably dimensioned, relative to the wave lengths of selected waves on the body of water in which a generator is used, for increasing the efficiency of power conversion. Further, a support means is provided for maintaining the structure in a preselected position within and below the surface of the water. The generating elements are preferably flexible and are supported in such a manner so as to allow flexure thereof in response to movement of the surrounding water.

U.S. Pat. No. 4,005,319 to Nilsson et al. discloses a piezoelectric generator operated by fluid flow. The generator for use with projectiles and the like comprises a piezoelectric element housed in a cavity through which air is forced during missile movement. A reed-like tongue in the cavity has one end captive while its other end is positioned near a ram air inlet. The ram air inlet terminates in a nozzle outlet which is aligned with the tongue and is so configured to enable ram air to impart vigorous vibration to the tongue. The piezoelectric element has a vibration transmitting connection with the tongue near the captive end of the latter for conducting electrical power to load circuitry in another part of the projectile.

U.S. Pat. No. 3,952,352 to Wan et al. discloses an electronic stroke effectiveness sensor for competitive swimmers. The sensor is a body worn apparatus that senses and measures the hydrodynamic thrust generated by a swimmer's hands as he strokes his hands through the water. The apparatus consists of pressure sensitive transducers that convert the thrust into electric signals that are fed back to the swimmer in terms of an audiotone. The frequency of the tone varies as a function of the thrust. Alternatively, the signals can be transmitted to a recording instrument calibrated to quantitatively meter and record the thrust generated by the swimmer's arm strokes.

While the above devices use a piezoelectric element for generating electrical power, none of the devices discussed are directed to a flipper or fin, for use underwater, for generating electric power in order to power underwater equipment. There exists, therefore, a need in this art for a piezoelectric power generating fin or flipper system for generating electricity underwater in order to ease the load now currently placed on divers when having to carry electrically powered devices and their power sources.

SUMMARY OF THE INVENTION

The primary object of this invention is to provide a system for use by underwater divers that allows for the generation of electrical energy via the natural movement of the diver.

Another object of this invention is to provide a flipper or fin which upon the movement thereof by a diver in water generates electricity for powering electrically powered devices underwater.

Yet another object of this invention is to provide a system for use by underwater divers for generating power from otherwise wasted energy.

Still another object of this invention is to provide a portable power generation system for use by underwater divers, which system eliminates the need to carry power packs or the like and which system can power devices such as photography equipment, sonar transducers, light sources and communication devices.

The foregoing objects are attained by the flipper energy source of the present invention which includes a flipper or fin having means for engaging a foot and a body portion extending therefrom. The body portion includes fluid displacing surfaces which are adapted to be moved through the fluid for creating a propelling force. Such movement causes stress to be created on the surfaces of the body portion. The device further includes means for generating electric power for powering electrical device(s), wherein the created stress is converted thereby into electric power.

In one embodiment of the invention, the means for generating comprises a piezoelectric element, preferably polyvinylidene fluoride (PVDF), embedded in at least one of the surfaces of the body portion. The invention further includes circuitry for transmitting the generated electrical energy to the electrically powered device. The circuitry may include an end positioned electrical connector which is adapted to connect to electrical devices such as a light source, a communication device, a location identifier, photography equipment, a sonar transducer and a battery charger, for example. In addition, the circuitry may be capable of conditioning the power provided from the PVDF with regard to, for example, voltage level regulation and power storage.

BRIEF DESCRIPTION OF THE DRAWINGS

Details of the present invention are set out in the following description and drawings where like reference characters depict like elements and wherein.

DESCRIPTION OF THE PREFERRED EMBODIMENT

Figure 1:
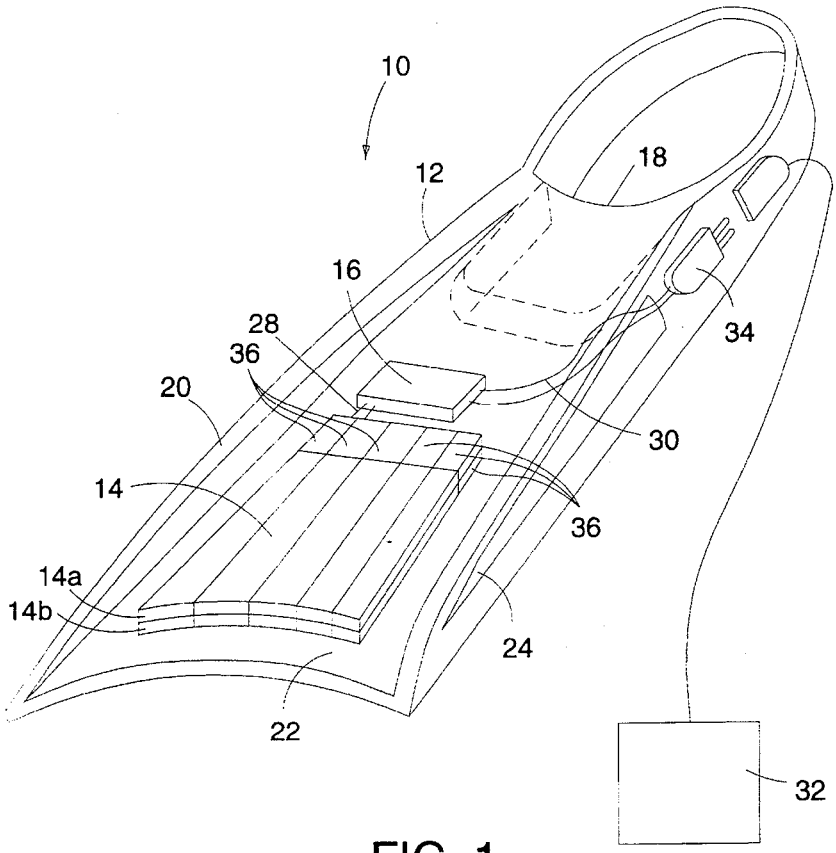
FIG. 1 is a perspective view of the power generating flipper system in accordance with the principles of the present invention.

Referring now to the drawings in detail, there is shown in FIG. 1 a perspective view of the flipper energy source system of the present invention, designated generally as 10. System 10 is generally comprised of a flipper 12, piezoelectric element 14, and conditioning circuitry 16.

Flipper 12 may be any fin or flipper used by scuba divers which is formed from neutrally buoyant compound material and which includes a body portion having a foot area 18 for engaging a foot, sidewalls 20 and surface 22. Reinforcement members 24 are molded into sidewalls 20 and are preferably semi-rigid for providing structural rigidity to flipper 12 while still allowing flexure thereof for sufficient activation of piezoelectric element 14.

Piezoelectric element 14, which is preferably formed from sections or layers of polyvinylidene fluoride (PVDF), is positioned in flipper 12. Piezoelectric element 14 is preferably embedded or layered into the neutrally buoyant compound material forming surface 22 of flipper 12. Two layers, **14*a* and 14*b* are indicated in FIG. 1. The number of layers and the widthwise expanse of the PVDF may be varied and are each chosen to obtain power generation sufficient for a variety of applications. These applications include the powering of multiple devices and devices which require different levels of power to function. The specific nature of the electric power generated, however, is conditioned as set forth below for particular scenarios via the use of different conditioning circuits. While embedded, the PVDF is surrounded on all sides by the neutrally buoyant material and is protected by the material from fluid infiltration. During swimming, stress is continuously created along surface 22 of flipper 12. The stress formed on surface 22 of flipper 12 is converted by piezoelectric element 14** into electrical energy.

The PVDF develops an electrical potential proportional to applied stress and provides an increasing amount of electrical potential as the cross-sectional area of the PVDF is increased. Accordingly, piezoelectric element 14 preferably spans a substantial portion of the width of surface 22, such that a large cross section may be stressed during the movement of flipper 12. The power generated by the PVDF element for the disclosed arrangement has been measured to provide 60–70 volts. The PVDF or other piezoelectric element material may also be provided in large or small blocks, or in multiple layers such that numerous elements become stressed and produce electricity. The electric power generated by piezoelectric element 14 may then be stored or otherwise conditioned by conditioning circuitry 16 prior to supplying electrical power to an electrically powered device carried by the diver.

Piezoelectric element 14 is preferably electrically connected via rectifying elements 36 and connecting wires 28 to conditioning circuitry 16. Circuit wires 30 provide an electrical path between conditioning circuitry 16 and the device to be powered, directing the power to the device 32. A water tight connector 34 is provided for connection of device 32 to circuit wires 30.

Figure 2:
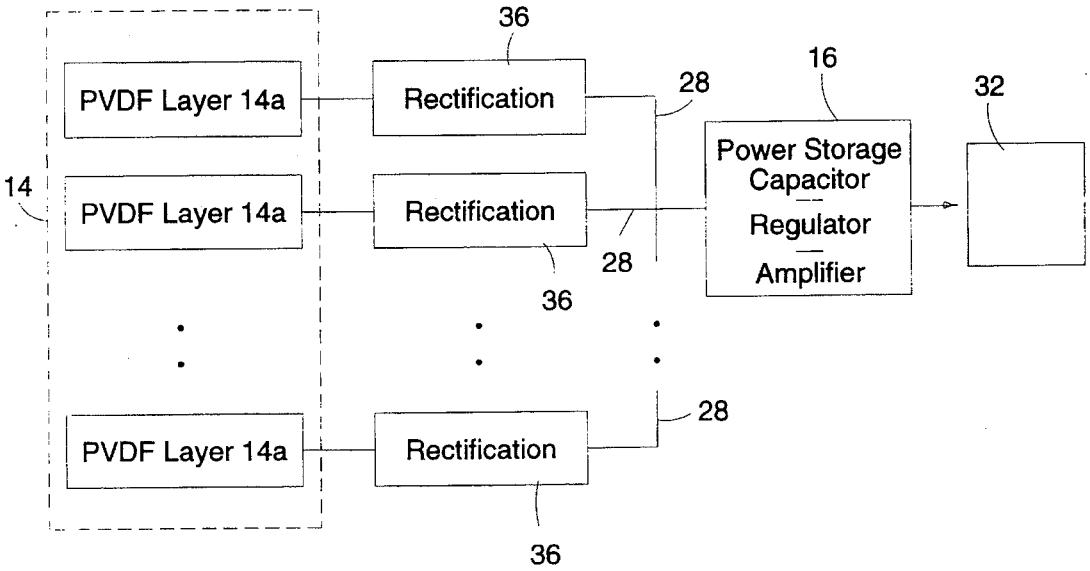
FIG. 2 is an electrical schematic of the circuit used in the present invention.

Referring now to FIG. 2, there is shown an electrical schematic of the circuit used in the present invention. Only layer **14*a* is shown in FIG. 2, but it is understood that additional layers may be present and circuits for additional layers would be similar to that shown for layer 14*a*. Piezoelectric element 14 generates electricity having an alternating current. Each layer of the PVDF material is preferably electrically connected such that the power generated thereby is first rectified by rectifying elements 36, as shown in the circuit schematic of FIG. 2, to convert the alternating current to a direct current. Rectifying elements 36 are preferably diodes placed in the circuit between the piezoelectric element 14 and conditioning circuitry 16, or alternatively may be incorporated in conditioning circuitry 16 itself. The diode functions to convert the alternating current into a direct current. Connecting wires 28 direct the rectified current to conditioning circuitry 16 in the preferred embodiment of FIG.2**.

In conditioning circuitry 16, electrical power is, for example, stored for powering devices where electrical energy is continuously needed, amplified to power devices requiring a stronger signal, or regulated to match the current or voltage to the specific needs of device 32 being powered, such that, for example, the 60–70 Volts output is reduced to a much lower amount, such as 5 Volts. These are only examples of the type of conditioning circuitry which can be provided. The conditioning circuitry and its particular function will depend on the type of equipment being powered. Combinations of the above-mentioned examples as well as others can also be used in the conditioning circuitry 16. In the preferred embodiment of FIG. 2, conditioning circuitry 16 comprises a regulator, an amplifier and a power storage capacitor which may be used in the conditioning circuitry such that if the diver ceased movement of the flippers, power could be continually supplied to device 32 via energy stored in the capacitor.

Connecting wires 28 and circuit wires 30 are preferably molded and embedded into the flipper foot or strap area and thus protected from fluid infiltration. Circuit wires 30 are connected to a water tight electrical connector 34 which is adapted to be connected with another electrical connector, leading to an electrical device such as, for example, and not by way of limitation, a light, a communication device, photography equipment, location identification equipment, a sonar transducer or a battery recharger, as indicated schematically in FIG. 1 and designated 32.

As an alternative to being embedded, piezoelectric element 14 and all of the electrical elements and connections can be attached to the surface of the flipper and provided with water tight seals for preventing water from shorting the circuitry of system 10.

System 10 is preferably used by placing flipper 12 on the foot and plugging electrically powered device 32 into connector 34 extending from conditioning circuitry 16. As the diver propels himself through the water, surface 22 of flipper 12 is stressed as is piezoelectric element 14, formed from PVDF, causing element 14 to generate electrical energy which is rectified by rectifying elements 36 as discussed above, and transmitted through connecting wires 28 and conditioning circuitry 16, as discussed above, and circuit wires 30, into electrical device 32. Electrical device 32, by way of example only, may be in the form of a light, photography equipment, battery recharger, sonar transducer or a location identifier, and is powered by the movement of flipper 12 through the water via the diver. The primary advantage of this invention is that a system is provided for use by underwater divers that allows for the generation of electrical energy via the natural movement of the diver. Another advantage of this invention is that a flipper or fin is provided which upon the movement thereof by a diver in water generates electricity for powering electrically powered devices underwater. Yet another object of this invention is that a system is provided for use by underwater divers for generating power from otherwise wasted energy. Still another object of this invention is that a power generation system is provided which is portable for use by underwater divers which does not require the carrying of power packs or the like and which can power devices such as photography equipment, sonar transducers, location identification devices, light sources and communication devices.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An underwater flipper system for generating power for use in underwater equipment, comprising:

a flipper having means for engaging a foot and a body portion extending from said foot engaging means having fluid displacing surfaces, said body portion being continously moved through a fluid by action of a user's foot; and a piezoelectric element adapted to generate said power through flexing stress created on at least one of said fluid displacing surfaces by said movement of said body portion.

2. The underwater power generating flipper system according to claim 1 wherein said piezoelectric element is formed from polyvinylidene fluoride.

3. The underwater power generating flipper system according to claim 1 wherein said piezoelectric element is embedded in at least one of said fluid displacing surfaces.

4. The underwater power generating flipper system according to claim 1 wherein said piezoelectric element is comprised of multiple layers of polyvinylidene fluoride.

5. The underwater power generating flipper system according to claim 3 further comprising means for connecting said electric power generating means to said underwater equipment.

6. The underwater power generating flipper system according to claim 5 wherein said connecting means comprises an electrical circuit.

7. The underwater power generating flipper system according to claim 6 wherein said circuit comprises electrical wires and an electrical plug, wherein said plug is adapted to connect with said underwater equipment device.

8. The underwater power generating flipper system according to claim 6 wherein said circuit is sealed from fluid infiltration.

9. The underwater power generating flipper system according to claim 6 wherein said circuit is embedded in at least one of said fluid displacing surfaces.

10. The underwater power generating flipper system according to claim 6 wherein said circuit further comprises conditioning circuity means for matching electric power requirements of the device to the electric power generating means.

11. The underwater power generating flipper system according to claim 10 wherein said conditioning circuitry means comprises a regulator for altering electric power voltage of the electric power generating means.

12. The underwater power generating flipper system according to claim 6 wherein said circuit further comprises means for rectifying the generated electric power for converting alternating current to direct current.

13. The underwater power generating flipper system according to claim 12 wherein said means for rectifying comprises a diode.

14. The underwater power generating flipper system according to claim 10 wherein said conditioning circuitry comprises means for storing the electric power generated by the electrical power generating means.

15. The underwater power generating flipper system according to claim 14 wherein said means for storing comprises a capacitor.

16. The underwater power generating flipper system according to claim 10 wherein said conditioning circuitry means further comprises means for rectifying the generated electric power for converting alternating current to direct current.

17. The underwater power generating flipper system according to claim 16 wherein said means for rectifying comprises a diode.

* * * * *